US005938914A

United States Patent [19]

Dawless et al.

[11] Patent Number: 5,938,914

[45] Date of Patent: Aug. 17, 1999

[54] MOLTEN SALT BATH CIRCULATION DESIGN FOR AN ELECTROLYTIC CELL

[75] Inventors: Robert K. Dawless, Monroeville; Alfred F. LaCamera, Trafford; R. Lee Troup; Siba P. Ray, both of Murrysville; Robert B. Hosler, Sarver, all of Pa.

[73] Assignee: Aluminum Company of America, Pittsburgh, Pa.

[21] Appl. No.: 08/934,252

[22] Filed: Sep. 19, 1997

[51] Int. Cl.[6] ..... C25C 3/22

[52] U.S. Cl. ..... 205/391; 205/395; 204/247

[58] Field of Search ..... 204/243.1, 242, 204/280, 194; 205/391, 395, 336, 380, 376, 375, 372

[56] References Cited

U.S. PATENT DOCUMENTS

| | | | |
|---|---|---|---|
| 4,002,551 | 1/1977 | Duclaux et al. | 204/247 |
| 4,033,846 | 7/1977 | Engesland | 204/247 |
| 4,073,703 | 2/1978 | Kinosz et al. | 204/70 |
| 4,110,178 | 8/1978 | LaCamera et al. | 204/64 R |
| 4,151,061 | 4/1979 | Ishikawa et al. | 204/247 |
| 4,243,502 | 1/1981 | Kugler | 204/243 R |
| 4,392,926 | 7/1983 | Ohta et al. | 204/67 |
| 4,720,333 | 1/1988 | Duval et al. | 204/241 |
| 4,869,790 | 9/1989 | Charles et al. | 204/64 |
| 4,960,501 | 10/1990 | Sivilotti | 204/244 |
| 5,071,534 | 12/1991 | Holmen et al. | 204/245 |
| 5,286,359 | 2/1994 | Richards et al. | 204/243 |
| 5,362,366 | 11/1994 | De Nora et al. | 204/67 |
| 5,368,702 | 11/1994 | de Nora | 204/67 |
| 5,725,744 | 3/1998 | De Nora et al. | 204/244 |

FOREIGN PATENT DOCUMENTS

| | | |
|---|---|---|
| 934587 | 8/1963 | European Pat. Off. . |
| 000192602 | 8/1986 | European Pat. Off. . |
| 1510171 | 11/1966 | France . |

OTHER PUBLICATIONS

Robert A. Lewis, Trends in Aluminum Cell Design, Chemical Engineering Progress, vol. 56, No. 5, May 1960.

*Primary Examiner*—Kathryn Gorgos
*Assistant Examiner*—Erica Smith-Hicks
*Attorney, Agent, or Firm*—Glenn E. Klepac

[57] ABSTRACT

An electrolytic cell for reduction of a metal oxide to a metal and oxygen has an inert anode and an upwardly angled roof covering the inert mode. The angled roof diverts oxygen bubbles into an upcomer channel, thereby agitating a molten salt bath in the upcomer channel and improving dissolution of a metal oxide in the molten salt bath. The molten salt bath has a lower velocity adjacent the inert anode in order to minimize corrosion by substances in the bath. A particularly preferred cell produces aluminum by electrolysis of alumina in a molten salt bath containing aluminum fluoride and sodium fluoride.

18 Claims, 4 Drawing Sheets

MOLTEN SALT BATH CIRCULATION DESIGN FOR AN ELECTROLYTIC CELL

PENDING RELATED APPLICATION

This application is related to copending U.S. Ser. No. 08/926,530, filed Sep. 10, 1997 for "Reduced Temperature Aluminum Production in an Electrolytic Cell Having an Inert Anode", still pending.

The Government has rights in this invention pursuant to Contract No. DE-FC07-89 ID 12848 awarded by the U.S. Department of Energy.

FIELD OF THE INVENTION

The present invention relates to the electrolytic production of a metal in a cell having a cathode, an inert anode and a molten salt bath containing a metal oxide. A preferred cell produces aluminum from a molten salt bath containing metal fluorides and alumina. More particularly, the invention relates to an improved design for circulating the molten salt bath within the cell.

BACKGROUND OF THE INVENTION

The cost of aluminum production can be reduced by substituting inert anodes for the carbon anodes now used in most commercial electrolytic cells. Inert anodes are dimensionally stable because they are not consumed during aluminum production. Using a dimensionally stable inert anode together with a wettable cathode allows more efficient cell designs, lower current densities and a shorter anode-cathode distance, with resulting energy savings.

One problem associated with inert anodes is that they may contain metal oxides having some solubility in molten fluoride salt baths. In order to reduce corrosion of the inert anodes, cells containing them should be operated at temperatures below the normal Hall cell operating range (approximately 948° to 972° C.). However, reduced temperature operation also poses some problems, including difficulty in maintaining an electrolyte saturated with alumina, solidification of electrolyte in the cell (sludging) and floating aluminum. In addition, some types of inert anodes tend to form resistive layers at lower operating temperatures.

In order to achieve low corrosion rates on the inert anodes, the alumina concentration must be maintained near saturation but without a high bath velocity near the anodes and without sludging of the cell. Some electrolyte circulation is required to dissolve the alumina, but circulation can also accelerate anode wear by circulating aluminum droplets. We have discovered that these problems can be avoided by providing a highly agitated alumina feed area, separated from the electrodes in order to improve alumina dissolution without also increasing corrosion of the inert anodes.

An important objective of the present invention is to provide an electrolytic cell having an inert anode and a slanted roof that diverts oxygen bubbles generated at the anode toward an upcomer channel wherein a metal oxide is dissolved.

A related objective of the invention is to provide a process for producing a metal in a cell having a molten salt bath, wherein a portion of the molten salt bath in an upcomer channel is agitated without any need for stirrers, pumps, or other conventional agitating means.

Additional objectives and advantages of our invention will become apparent to persons skilled in the art from the following detailed description.

SUMMARY OF THE INVENTION

The present invention relates to production of a metal by electrolytic reduction of a metal oxide to a metal and oxygen. A preferred embodiment relates to production of aluminum by electrolytic reduction of alumina dissolved in a molten salt bath. An electric current is passed between an inert anode and a cathode through the salt bath, thereby producing aluminum at the cathode and oxygen at the anode. The inert anode preferably contains at least one metal oxide and copper, more preferably the oxides of at least two different metals and a mixture or alloy of copper and silver.

Our electrolytic cell operates at a temperature in the range of about 700°–940° C., preferably about 900°–940° C., more preferably about 900°–930° C. and most preferably about 900°–920° C. An electric current is passed between the inert anode and a cathode through a molten salt bath comprising an electrolyte and alumina. In a preferred cell, the electrolyte comprises aluminum fluoride and sodium fluoride, and the electrolyte may also contain calcium fluoride, magnesium fluoride and/or lithium fluoride. The weight ratio of sodium fluoride to aluminum fluoride is preferably about 0.7 to 1.1. At an operating temperature of 920° C., the bath ratio is preferably about 0.8 to 1.0 and more preferably about 0.96. A preferred molten salt bath suitable for use at 920° C. contains about 45.9 wt. % NaF, 47.85 wt. % $AlF_3$, 6.0 wt. % $CaF_2$ and 0.25 wt. % $MgF_2$.

A particularly preferred cell comprises a plurality of generally vertical inert anodes interleaved with generally vertical cathodes. The inert anodes preferably have an active surface area about 0.5 to 1.3 times the surface area of the cathodes.

Reducing the cell bath temperature down to the 900°–920° C. range reduces corrosion of the inert anode. Lower temperatures reduce solubility in the bath of ceramic inert anode constituents. In addition, lower temperatures minimize the solubility of aluminum and other cathodically produced metal species such as sodium and lithium which have a corrosive effect upon both the anode metal phase and the anode ceramic constituents.

Inert anodes useful in practicing our invention are made by reacting a reaction mixture with a gaseous atmosphere at an elevated temperature. The reaction mixture comprises particles of copper and oxides of at least two different metals. The copper may be mixed or alloyed with silver. The oxides are preferably iron oxide and at least one other metal oxide which may be nickel, tin, zinc, yttrium or zirconium oxide. Nickel oxide is preferred. Mixtures and alloys of copper and silver containing up to about 30 wt. % silver are preferred. The silver content is preferably about 2–30 wt. %, more preferably about 4–20 wt. %, and optimally about 5–10 wt. %, remainder copper. The reaction mixture preferably contains about 50–90 parts by weight of the metal oxides and about 10–50 parts by weight of the copper and silver.

The alloy or mixture of copper and silver preferably comprises particles having an interior portion containing more copper than silver, and an exterior portion containing more silver than copper. More preferably, the interior portion contains at least about 70 wt. % copper and less than about 30 wt. % silver, while the exterior portion contains at least about 50 wt. % silver and less than about 30 wt. % copper. Optimally, the interior portion contains at least about 90 wt. % copper and less than about 10 wt. % silver, while the exterior portion contains less than about 10 wt. % copper and at least about 50 wt. % silver. The alloy or mixture may be provided in the form of copper particles coated with silver. The silver coating may be provided, for example, by electrolytic deposition or by electroless deposition.

The reaction mixture is reacted at an elevated temperature in the range of about 750°–1500° C., preferably about 1000°–1400° C. and more preferably about 1300°–1400° C. In a particularly preferred embodiment, the reaction temperature is about 1350° C.

The gaseous atmosphere contains about 5–3000 ppm oxygen, preferably about 5–700 ppm and more preferably about 10–350 ppm. Lesser concentrations of oxygen result in a product having a larger metal phase than desired, and excessive oxygen results in a product having too much of the phase containing metal oxides (ferrite phase). The remainder of the gaseous atmosphere preferably comprises a gas such as argon that is inert to the metal at the reaction temperature.

In a preferred embodiment, about 1–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the metal oxides, copper and silver.

The inert anodes of our invention have ceramic phase portions and alloy phase portions or metal phase portions. The ceramic phase portions may contain both a ferrite such as nickel ferrite or zinc ferrite, and a metal oxide such as nickel oxide or zinc oxide. The alloy phase portions are interspersed among the ceramic phase portions. At least some of the alloy phase portions include an interior portion containing more copper than silver and an exterior portion containing more silver than copper.

A particularly preferred cell comprises a chamber, at least one cathode and at least one inert anode in the chamber, and a roof over the inert anode. The chamber has a floor and at least one side wall extending upwardly of the floor. The chamber contains a molten salt bath. A preferred salt bath comprises at least one metal fluoride selected from sodium fluoride, aluminum fluoride and cryolite.

The cell preferably includes a plurality of cathodes interleaved with inert anodes. The cathodes and anodes each include a first end portion adjacent a downcomer channel and a second end portion adjacent an upcomer channel spaced laterally from the downcomer channel. A roof angled upwardly from the first end portion to the second end portion extends over the interleaved cathodes and inert anodes. In a preferred cell, a baffle extends downwardly from the roof adjacent the downcomer channel.

The roof extends upwardly at an angle of about 2°–50° from horizontal, preferably about 3°–25°. A particularly preferred roof extends upwardly at an angle of about 10°. The angled roof and the baffle divert oxygen bubbles released from the anodes toward the upcomer channel. An upward flow of oxygen bubbles in the upcomer channel agitates the molten salt bath and improves dissolution of the metal oxide. The molten salt bath has a greater velocity in the upcomer channel than adjacent the inert anodes, so as to minimize corrosion of the inert anodes by dissolved aluminum or other substances carried by the bath.

The roof has a lower surface or lower surface portion. Alternatively, the lower surface portion may define at least one slot extending between the first and second end portions. The slot increases capacity for carrying oxygen bubbles to the upcomer channel, thereby avoiding excessive accumulation of bubbles proximate the inert anodes.

DETAILED DESCRIPTION OF PREFERRED EMBODIMENTS

Figure 1:
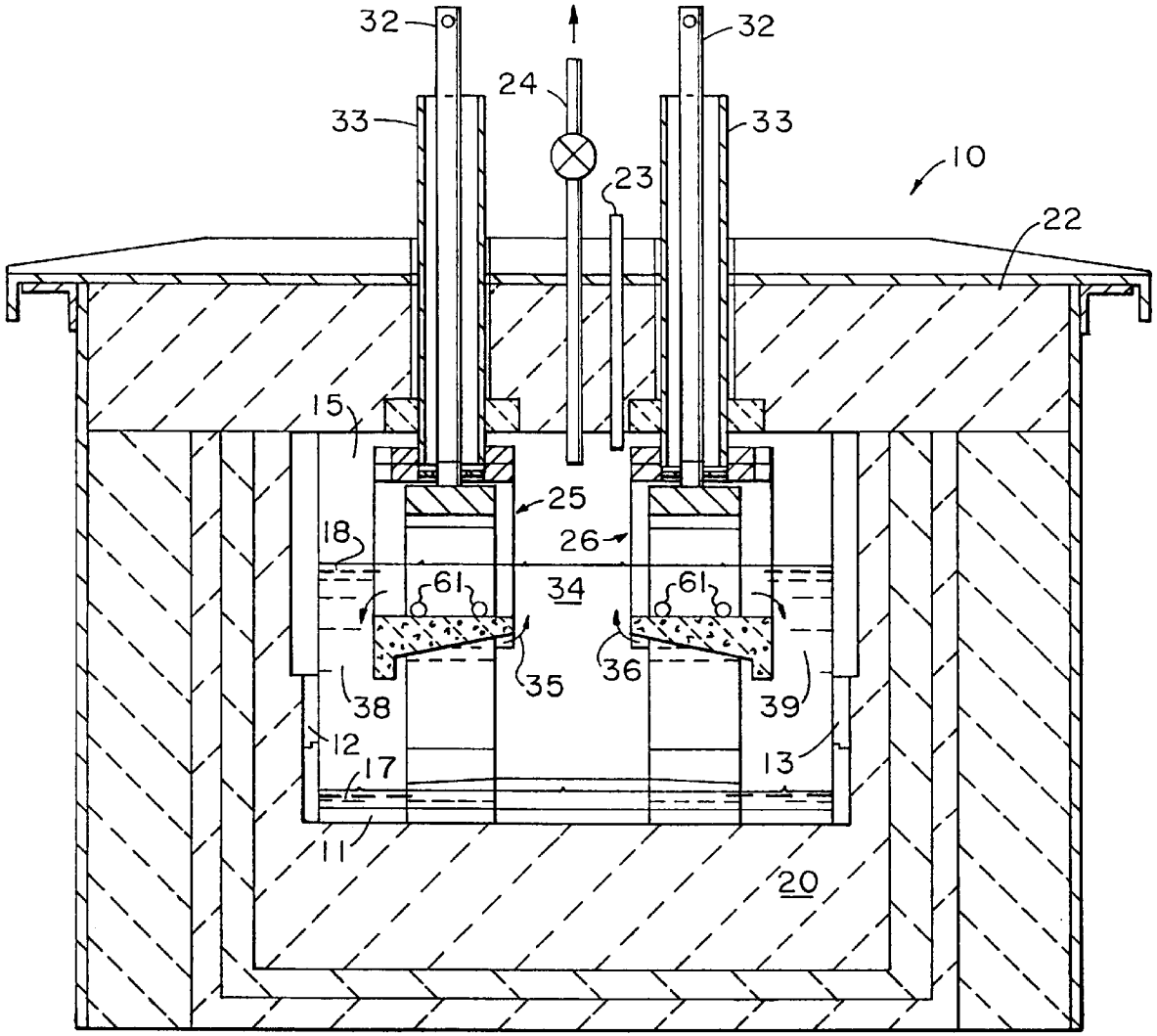
FIG. 1 is a cross-sectional view of an experimental electrolytic cell of the invention.

An electrolytic cell 10 of our invention is shown in FIG. 1. The cell 10 includes a floor 11 and side walls 12, 13 defining a chamber 15. The floor 11 is carbonaceous and electrically conductive. A molten aluminum pad 17 covers the floor 11. A molten salt bath 18 partially fills the chamber 15, above the pad 17. Refractories 20 extend around the side walls 12, 13 and below the floor 11. An insulating lid 22 extends above the chamber 15. Gases escape from the chamber 15 through a vent 23. An alumina feeder 24 extends through the lid 22.

The cell 10 includes two electrolysis modules 25, 26, each including several interleaved cathodes and inert anodes. The cathodes are supported by the floor 11.

Figure 2:
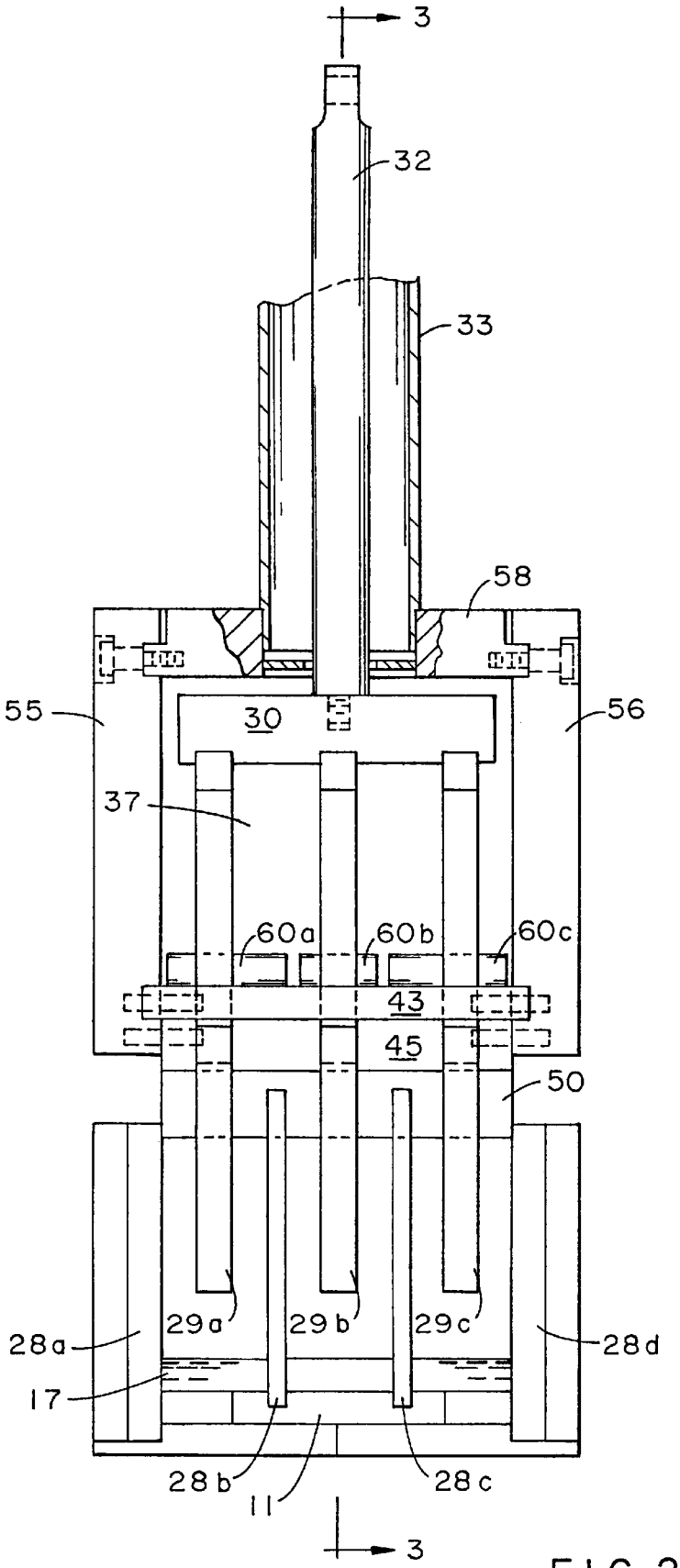
FIG. 2 is a fragmentary view of one unit of the electrolytic cell of FIG. 1.
Figure 3:
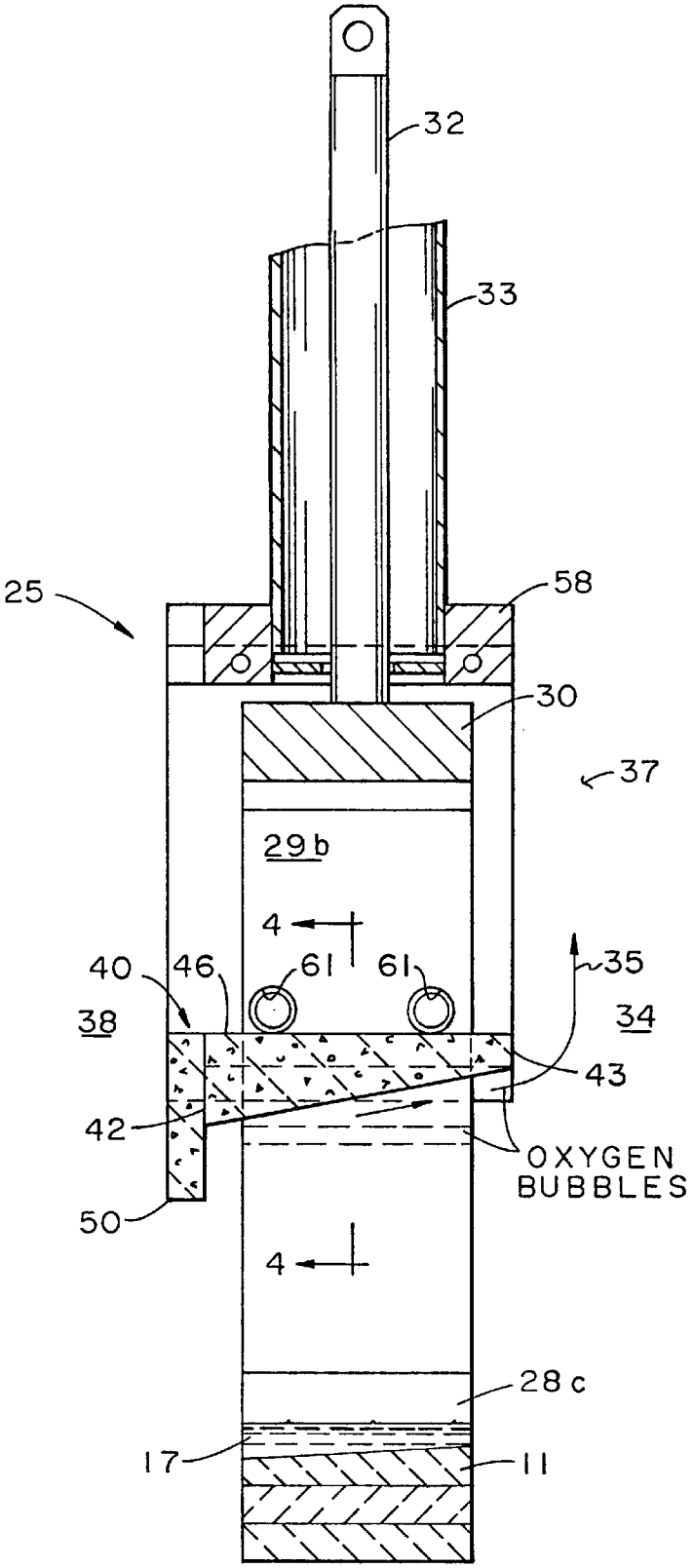
FIG. 3 is a cross-sectional view taken along the lines 3—3 of FIG. 2.

One of the electrolysis units 25 is shown in greater detail in FIGS. 2 and 3. The unit 25 includes four titanium diboride cathodes or cathode plates 28*a*, 28*b*, 28*c*, 28*d* embedded in the floor 11 and extending upwardly into the molten salt bath 18. Three inert anodes 29*a*, 29*b*, 29*c* extend downwardly from an anode assembly plate 30 connected to a nickel alloy rod 32 inside a metal support cylinder 33. The support cylinder 33 is preferably made from a nickel alloy. Electric current is supplied to the inert anodes through the rod 32 and assembly plate 30. We contemplate that a commercial cell will include a far greater number of anodes and cathodes in each module than in the experimental cell shown and described herein. The anodes and cathodes in a commercial cell will be larger than the ones shown and described herein.

The cell 10 produces aluminum when electric current passing between the anodes 22*a*, 22*b*, 22*c* and cathodes 20*a*, 20*b*, 20*c*, 20*d* reduces alumina dissolved in the bath 18 to aluminum and oxygen. Aluminum made at the cathodes drops along the cathodes into the molten metal pad 17. Oxygen bubbles generated at the anodes rise upwardly into a space 37 in the chamber 15 above the bath 18. The oxygen is then vented to the outside.

In prior art electrolysis cells having carbon anodes and operated at temperatures of about 948°–972° C., alumina dissolves readily in the molten salt bath so that there is little need to speed dissolution by mechanically agitating the bath. However, in electrolysis cells having cermet anodes, the anodes have a tendency to corrode at those temperatures. Cermet anode corrosion can be controlled by cooling the bath to temperatures in the range of about 700°–940° C., preferably about 900°–940° C. At those lower temperatures, alumina dissolves more slowly so that there is a greater need to stir the bath.

As shown in FIG. 1, the foregoing objectives are accomplished by providing an upcomer channel 34 wherein oxygen bubbles generated at the anodes float upwardly in the direction of arrows 35, 36. The upwardly rising bubbles agitate the molten salt bath in the channel 34 to improve dissolution of alumina deposited there through the alumina feeder 24. A circulation pattern is established by providing downcomer channels 38, 39 between the side walls 12, 13 and the electrolysis units 25, 26. Molten salt bath containing dissolved alumina sinks downwardly in the channels 38, 39, eventually reaching electrodes in the units 25, 26.

The circulation of molten salt bath 18 is improved by providing a roof 40 over the anodes 29*a*, 29*b*, 29*c* as shown in FIGS. 2 and 3. The roof 40 has a first end portion 42 adjacent the downcomer channel 38 and a second end portion 43 adjacent the upcomer channel 34. The roof 40 has a lower surface or lower surface portion 45 that is angled upwardly from the first end portion 42 to the second end portion 43. In the particularly preferred embodiment shown in FIG. 3, the lower surface 45 extends at about a 10° angle to horizontal.

The roof 40 also includes a baffle 50 extending downwardly from the horizontal upper surface 46 adjacent the first end portion 42. The baffle 50 improves bath circulation by preventing oxygen bubbles from rising upwardly in the downcomer channel 38.

The roof 40 is supported by vertically extending support walls 55, 56 joined to a horizontally extending support shelf 58. The shelf 58 is joined to a lower end of the support cylinder 33. The roof 40 supports the anodes 29*a*, 29*b*, 29*c* by pins 60*a*, 60*b*, 60*c* extending through openings 61 adjacent the roof upper surface 46. When the support cylinder 33 and the shelf 38 are elevated, the support walls 55, 56 lift the roof 40 upwardly so that the pins 60*a*, 60*b*, 60*c* also lift the anodes 29*a*, 29*b*, 29*c*. The anodes 29*a*, 29*b*, 29*c* are lifted upwardly to reduce the effective surface area between the anodes 29*a*, 29*b*, 29*c* and the cathodes 28*a*, 28*b*, 28*c*, 28*d*. Similarly, the interelectrode surface area is increased by lowering the anodes 29*a*, 29*b*, 29*c*, 29*d*. When cell current is constant, increasing the effective interelectrode area will decrease the voltage and decrease the cell temperature, and reducing the effective interelectrode area will increase the cell voltage and increase the cell temperature.

The roof 40, baffle 50, support walls 55, 56, shelf 58 and pins 60*a*, 60*b*, 60*c* can all be made from cermet anode materials or similar materials.

Figure 4:
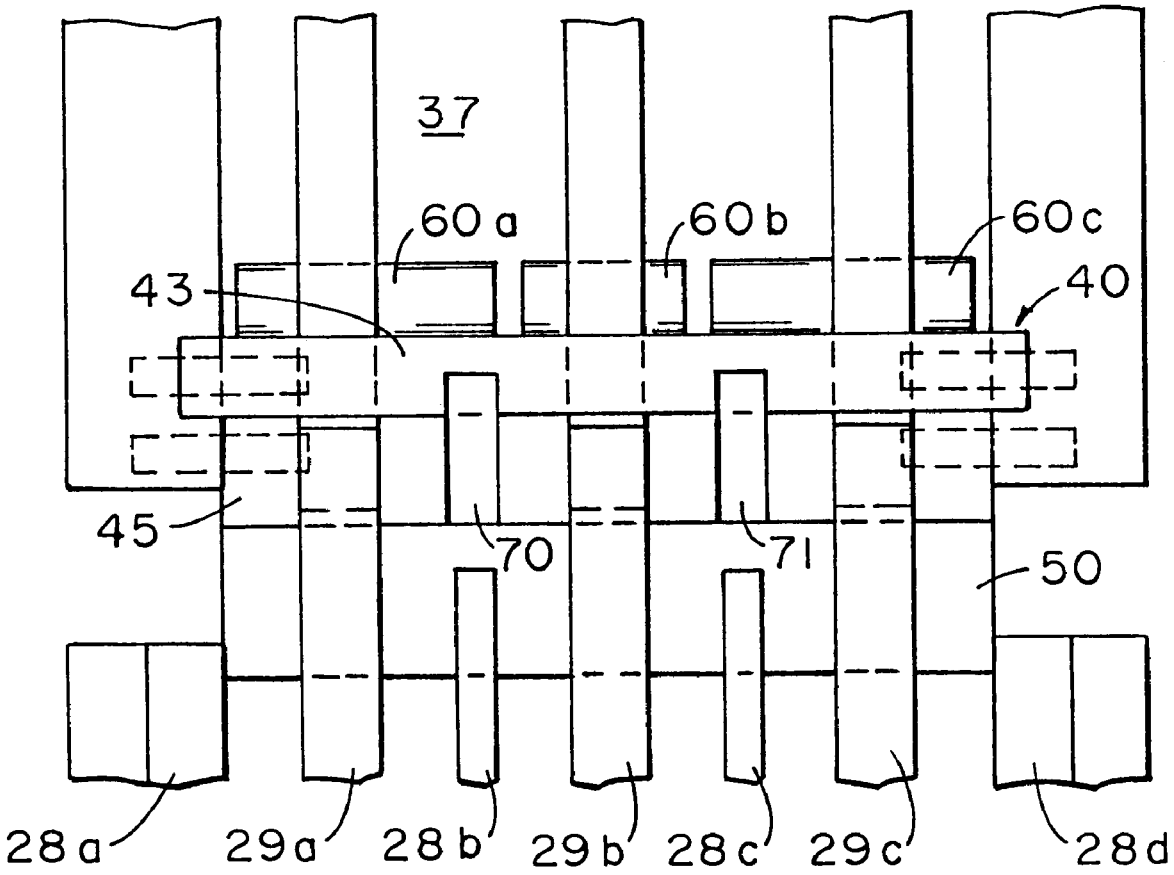
FIG. 4 is a fragmentary cross-sectional view of a roof for an alternative electrolytic cell of the invention taken along the lines 4—4 of FIG. 3.

In an alternative embodiment shown in FIG. 4, the roof 40 has a lower surface portion 45 defining two slots 70, 71. The slots 70, 71 extend between the baffle 50 and the second end portion 43. The slots 70, 71 increase the capacity for carrying oxygen bubbles from the inert anodes to the upcomer channel, thereby avoiding excessive accumulation of such bubbles under the roof 40.

Having described the presently preferred embodiments, it is to be understood that the invention may be otherwise embodied within the scope of the appended claims.

What is claimed is:

1. A cell for producing metal by electrolytic reduction of a metal oxide to a metal and oxygen, comprising:

(a) a chamber having a floor and at least one side wall extending upwardly of said floor, said chamber containing a molten salt bath comprising molten salts and a metal oxide soluble in said molten salts;

(b) at least one cathode and at least one inert anode in said chamber, said anode including a first end portion adjacent a downcomer channel and a second end portion adjacent an upcomer channel spaced laterally from said downcomer channel; and (c) a roof over said inert anode, said roof having a lower surface portion angled upwardly from said first end portion to said second end portion, where oxygen bubbles released adjacent said anode are diverted into said upcomer channel to agitate said molten salt bath in said upcomer channel and to improve dissolution of the metal oxide in said molten salt bath.

2. The cell of claim 1 comprising a plurality of cathodes interleaved with a plurality of inert anodes.

3. The cell of claim 1 wherein said molten salts comprise at least one metal fluoride selected from sodium fluoride, aluminum fluoride and cryolite and said metal oxide comprises alumina.

4. The cell of claim 1 further comprising a baffle extending downwardly from said roof adjacent said downcomer channel.

5. The cell of claim 1 wherein said lower surface portion of the roof defines at least one slot extending between said first end portion and said second end portion.

6. The cell of claim 1 wherein said roof extends upwardly at an angle of about 2–50° from horizontal.

7. The cell of claim 1 wherein said roof extends upwardly at an angle of about 3–25° from horizontal.

8. The cell of claim 1 wherein said roof extends upwardly at an angle of about 10° from horizontal.

9. The cell of claim 1 further comprising:

(d) a lid over said chamber;

(e) a metal support cylinder extending downwardly through said lid into said chamber; and (f) at least one support wall connected to said metal support cylinder, said support wall supporting said roof.

10. The cell of claim 9 further comprising:

(g) at least one pin supported by said roof and extending through an opening in said inert anode.

11. A process for electrolytic production of a metal in a cell comprising a chamber containing an anode, a cathode and a molten salt bath comprising molten salts and a metal oxide, said anode and said cathode each having a first end portion adjacent a downcomer channel and a second end portion adjacent an upcomer channel, said process comprising:

(a) electrolyzing said metal oxide by passing an electric current between said anode and said cathode to form a metal at said cathode and oxygen bubbles at said anode, said oxygen bubbles rising in said molten salt bath;

(b) diverting said oxygen bubbles toward said second end portion of by means of a roof angled upwardly from said first end portion toward said second end portion, said oxygen bubbles agitating said molten salt bath in said upcomer channel; and (c) introducing a metal oxide into the agitated molten salt bath in said upcomer channel.

12. The process of claim 11 wherein said metal comprises aluminum and said metal oxide comprises alumina.

13. The process of claim 12 wherein said molten salt bath comprises aluminum fluoride and sodium fluoride.

14. The process of claim 12 wherein said molten salt bath has a temperature of about 700°–940° C.

15. The process of claim 12 wherein said molten salt bath has a temperature of about 900°–930° C.

16. The process of claim 11 wherein said roof extends upwardly at an angle of about 2–50° from horizontal.

17. In a process for electrolytic production of aluminum in a cell comprising an inert anode, a cathode and a molten salt bath comprising alumina dissolved in metal fluorides, said process comprising electrolyzing said alumina by passing an electric current between said inert anode and said cathode to form aluminum at said cathode and oxygen at said inert anode, said oxygen forming bubbles rising in said molten salt bath, the improvement wherein said inert anode and said cathode each have a first end portion adjacent a downcomer channel and a second end portion adjacent an upcomer channel, said process further comprising:

diverting said oxygen bubbles into said upcomer channel by means of a roof having a lower surface portion angled upwardly from said first end portion toward said second end portion so that said oxygen bubbles agitate said molten salt bath in said upcomer channel, and introducing alumina into the agitated molten salt bath in said upcomer channel.

18. The process of claim 17 wherein said molten salt bath comprises at least one metal fluoride selected from aluminum fluoride, sodium fluoride and cryolite, said bath having a temperature of about 900–940° C.

* * * * *